United States Patent [19]

Mawardi

[11] 4,157,953

[45] Jun. 12, 1979

[54] MAGNETIC SEPARATION OF IRON PYRITE FROM COAL

[76] Inventor: Osman K. Mawardi, 15 Mornington La., Cleveland Heights, Ohio 44106

[21] Appl. No.: 763,571

[22] Filed: Jan. 28, 1977

[51] Int. Cl.[2] ..... B03C 1/10

[52] U.S. Cl. ..... 209/213; 209/227

[58] Field of Search ..... 209/218, 227, 223 R, 209/214; 210/222, 223, 213

[56] References Cited

U.S. PATENT DOCUMENTS

| | | | |
|---|---|---|---|
| 1,425,235 | 8/1922 | Bradley | 209/227 X |
| 3,294,237 | 12/1966 | Weston | 209/227 X |
| 3,567,026 | 3/1971 | Kolm | 210/222 |
| 3,822,016 | 7/1974 | Jones | 209/223 R X |
| 3,887,457 | 6/1975 | Marston | 209/214 |
| 3,994,801 | 11/1976 | Colburn | 209/214 |

FOREIGN PATENT DOCUMENTS

| | | | |
|---|---|---|---|
| 14908 | 9/1962 | Japan | 209/218 |
| 21374 | 12/1904 | Sweden | 209/218 |
| 18420 | 8/1910 | United Kingdom | 209/227 |
| 428783 | 7/1972 | U.S.S.R. | 209/227 |

*Primary Examiner*—Robert Halper

*Attorney, Agent, or Firm*—Fay & Sharpe

[57] ABSTRACT

A high gradient magnetic separator particularly for the desulfurization of coal. The process and apparatus are continuous and suitable for high volumes of material in a fluid stream. They employ the concept of a high gradient magnetic field through a stream of material that has some portion of magnetic particles which are to be separated. Within the separator is a matrix of magnetizable material, such as stainless steel wool. A magnetic field is formed of a series of magnetic coils surrounding the stream of material from the inlet to an outlet. Each of the coils are magnetized and then demagnetized in sequence so as to drop or release magnetic particles from the steel wool to the fluid stream as it flows through the separator.

As the magnetic particles concentrate they are flushed out through a diverter valve for a short moment and the process continues. Passage of the stream of material is continuous for all practical purposes. During all other portions of the cycle the field is turned on and the magnetic particles attach to the matrix until the next cycle of demagnetization when they go into the fluid stream (gas or slurry) and concentrate and pass through the diverter valve. The main stream of material is thus cleared of magnetic particles. The frequency of the sequential flushing would be dependent upon the concentration of the magnetic particles in the stream of materials. In any event the demagnetization would be sequenced with speed of the fluid stream.

8 Claims, 10 Drawing Figures

Proposed separator. The pipe PP is filled with a matrix of stainless steel wool. The coal as a slurry is made to flow into PP. The field $B_o$ is produced by the coils $C_1$, $C_2$ ... which are inserted into a yoke Y. A traveling magnetic wave causes the concentration of pyrite to increase (see Fig. 5). At periodic intervals water from TT' flushes away the enriched slurry.

FIG. 3

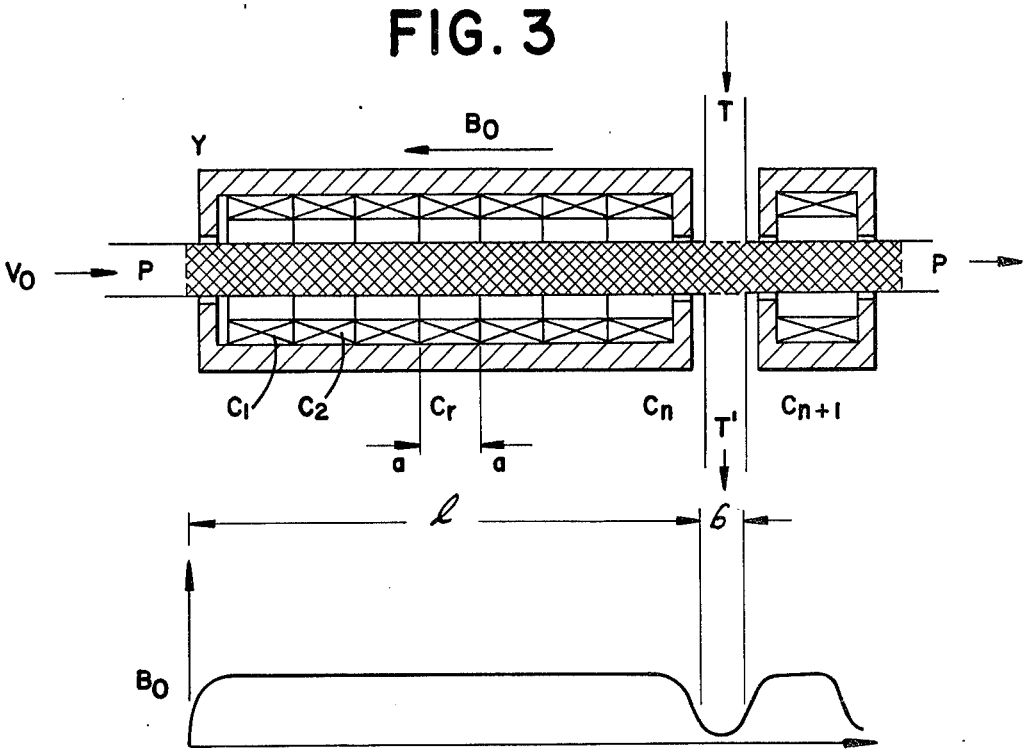

Proposed separator. The pipe PP is filled with a matrix of stainless steel wool. The coal as a slurry is made to flow into PP. The field $B_o$ is produced by the coils $C_1$, $C_2$ ... which are inserted into a yoke Y. A traveling magnetic wave causes the concentration of pyrite to increase (see Fig. 5). At periodic intervals water from TT' flushes away the enriched slurry.

FIG. 4

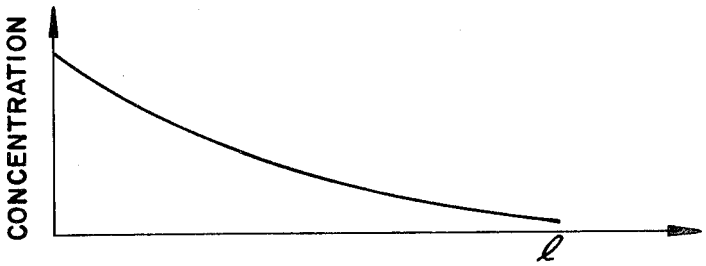

Distribution of the concentration of the pyrite under static condition (i.e. no traveling wave).

Illustrates the shape of magnetic lines of force of 3 consecutive coils $C_{r-1}$, $C_r$, $C_{r+1}$ in which the field due to $C_r$ opposes that its immediate neighbors causing the magnetic intensity to be as shown in Fig. 5(b).

FIG.6

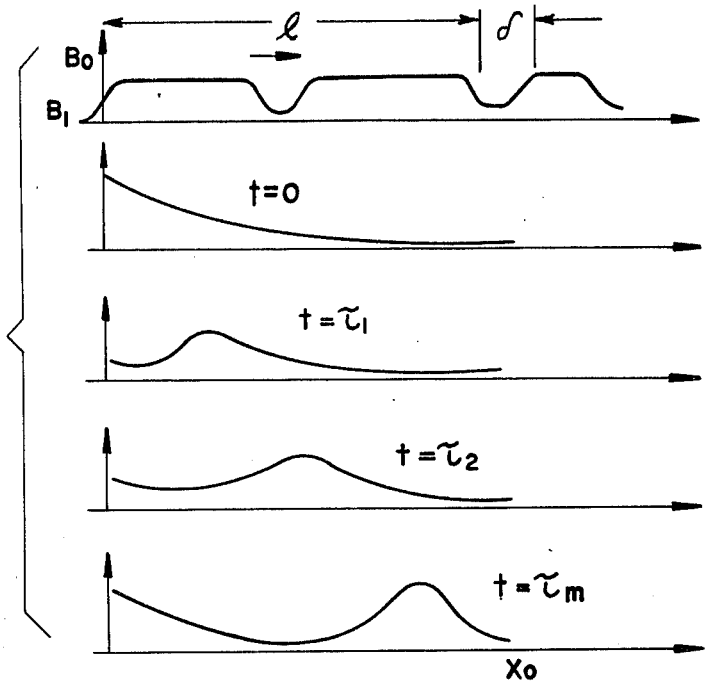

Temporal evolution of the concentration distribution of the "mags" as a result of the moving magnetic pulse shown in the first line of the figure. When the concentration peak occurs at $x_o$, the "mags" are flushed out.

FIG.7

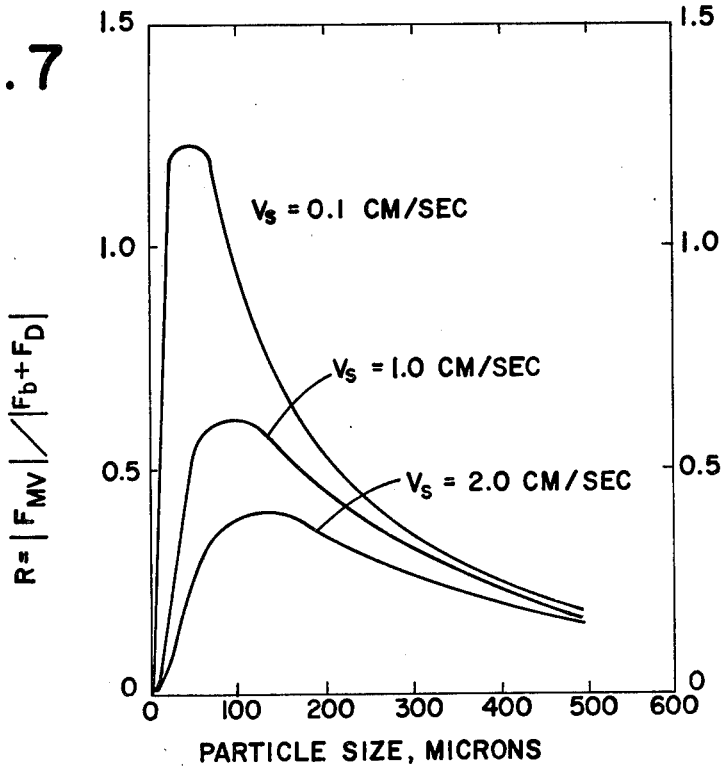

Effect of particle size on the ratio of magnetic force to opposing forces on a pyrite particle ($\chi = 25 \times 10^{-6}$ cgs units; field = 20 kOe; wire diameter = 100μm; $R_p$ = particle radius + 150μm; $\theta_p$ = 0 radians).

Effect of particle size on sulfur recovery in mags (field = 20 kOe steel screens packing = 91 percent void; slurry concentration = 2.6 gm/100 mℓ; slurry velocity = 2.3-2.6 cm/sec).

Typical particle trajectories in the x-y plane (perpendicular to the axis of the fiber) for values of the parameter $\frac{V_m}{V_o}\phi = \frac{y}{b}$ and $\xi = b$.

MAGNETIC SEPARATION OF IRON PYRITE FROM COAL

BACKGROUND OF THE INVENTION

At the present time raw coal contains three forms of sulfur, i.e., organic, sulfate and pyritic. A portion of this pyritic sulfur can be gravimetrically separated. With the EPA standard of 1.2 pounds of $SO_2$ emission per million (MM) BTU there has been considerable difficulty in removing sulfur to meet this standard.

Coal burned by coal fired electric utility plants is the principal source of sulur oxide air pollution. Thus there is a need to remove as much sulfur as possible from the coal. In a typical year 1974, electric utilities burned 390 million tons of coal with an average sulfur content of 2.2%.

Suflur can be removed from coal by three methods - (1) Gravimetric separation (heavy organic liquids) of pyritic sulfur prior to combustion, (2) Flue gas scrubbing to remove $SO_2$ such as in U.S. Pat. No. 3,752,877, and (3) Coal conversion to a clean fuel by gasification, liquefaction or chemical extraction.

Of all these methods pyritic sulfur removal is cheapest, but organic sulfur cannot be removed and the EPA limits are still difficult to meet.

Pyritic sulfur occurs naturally in coal as pyrite and as a discrete particle. It has a specific gravity of about 5.0 as compared to coal which is only 1.7 as a maximum. Gravimetric separation will reduce the sulfur significantly, but leaves behind organic sulfur and sulfate containing sulfur (usually less than 0.05%).

As a general rule, raw coal contains on the average 14.0% ash, 1.91% pyritic sulfur and 3.02% total sulfur (Bureau of Mines R.I. 8118/1976).

This invention is directed to a novel process of removing continuously as high a percentage of pyritic sulfur as possible at low cost. Even good gravimetric separation will only reduce pyritic sulfur from 2.01% to 0.66% or 65% reduction leaving 0.66% pyritic which when added to other sulfur will still be excessive by EPA standards. This invention is directed to removing the pyritic sulfur magnetically either as a separate step or in combination with other sulfur removal techniques depending on process considerations and cost.

One example of prior art technology as applied to Clay is U.S. Pat. No. 3,676,337, but this is not really a continuous process but calls for periodic flushing.

This application is believed to have application in the removal of any ferro magnetic or paramagnetic material from an ore or raw material. In this connection, the removal of iron from bauxite or shales from coal may be other applications.

SUMMARY OF THE INVENTION

This invention relates to a high gradient magnetic separator and method therefor, which operates in a continuous mode without recourse to mechanical moving parts.

In the invention coal or other raw material is placed in a fluid stream of, gas or slurry, and moved into an elongated container or pipe PP which forms the core of the separator. This container or pipe is filled with a matrix of magnetizable material which in one form is stainless steel wool. The relative alignment of the fibers and directions of flow of the magnetic field are similar to that of conventional separators as in U.S. Pat. No. 3,887,457, 3,627,678, or 3,567,026 and are shown diagrammatically in FIG. 1.

In the invention coils $C_1$, $C_2$ . . . Cn are energized, the concentration of pyrite in PP is according to the exponential law shown in Eq (4) and schematically in FIG. 4.

When the field in one of the coils, say $C_r$ is reversed, the intensity of the field in the region aa inside PP is reduced. The configuration of the lines of force are represented in FIG. 5(*a*) which describes the partial cancellation of the fluid so as to produce a distribution similar to that in FIG. 5(*b*).

When the field in aa falls below the critical value taught by Watson (see FIG. 9 and Ref. 6), the pyrite is no longer trapped by the steel wool in aa and is swept away from aa by the incoming flow of slurry arriving with a velocity $V_o$. If the various coils $C_1$, $C_2$ . . . are reversed in sequence, a traveling magnetic wave propagates down the pipe PP and the corresponding concentration of the trapped pyrite changes from that in FIG. 4 in sequence through the distributions shown in FIG. 6 where the temporal evolution of the distribution for concentration is displayed.

If the speed of propagation of the magnetic wave is $V_m$, then after a time $\tau_m=(l/V_m)$ the concentration of pyrite is a maximum at the end of the separator where 1 is the total length of the coils $C_1$-$C_n$. Since at that time the magnetic field for coil $C_n$ is lowest, the pyrite is washed out of the region of coil $C_n$ by the incoming flow and is transported in the region $\delta$ which is field free. At that instance a pulse of water is injected at T which is a diverter means so that the pyrite (as well as some coal) is flushed out and leaves by the pipe T'. The additional coil $C_{n+1}$ is placed there to trap any residual pyrite that has seeped through PP post the diverter.

The enriched (in pyrite) slurry which leaves at T' is refiltered by another smaller separator or simply discarded. The amount of coal that is periodically ejected at T' can be calculated as follows: Every $\tau_m$ seconds, the volume of coal lost is $\delta A$ (where A is the cross-sectional area of PP). During that interval the flow discharge is $AV_o\tau_m$. The fractional loss is $\delta/V_o\tau_m$.

If this coal is filtered through an identical filter then the loss becomes $(\delta/V_o\tau_m)^2$ and is much less than 1%. Then a two-stage filter would be more adequate to reduce the coal losses to an insignificiant amount.

BACKGROUND OF THE PRESENT INVENTION

High Gradient Magnetic Separators as a Continuous Process

Conventional magnetic separators as shown in FIG. 1 have the disadvantage of being operable only in a batch process mode. This is due to the fact that after a certain time which depends on the concentration of the "mags" in the slurry the steel wool becomes saturated with the amount of mags clinging to it. Consequently, the filtration is interrupted, the magnetic field is turned off and the separator is flushed to remove the mags.

This procedure cannot be used for desulfurization since the amount of coal treated is very large and the filtration cannot be interrupted, specially when the coal is used in conjunction with a power plant. Accordingly several suggestions have been made to provide a separator to be operated in a continuous manner. Although there have been several separators suggested (9, 10), the concept is basically the same and consists in physically moving the matrix of steel wool from a region permeated with a magnetic field to another where there is no magnetic field. The matrix is then flushed to remove the mags which are no longer trapped by the magnetic field. The carousel separator, a typical prior art device for these continuous feed separators, is shown in FIG. 2.

A serious disadvantage of this device is due to the highly abrasive character of the slurry. The wear on the moving carousel is hence expected to be high. Another drawback is the slow speed of the process caused by the fact that the carousel has to move fairly slowly (because of its large size).

BRIEF DESCRIPTION OF THE DRAWINGS

FIG. 3 is a diagrammatic view of the invention showing the inlet, outlet, diverter valve and coils;

FIG. 4 is a diagrammatic view of the concentration of pyrite under static conditions;

FIG. 5(*b*) is a magnetic intensity diagram of FIG. 5(*a*);

FIG. 6 is a graph showing the temporal evolution of the concentration distribution of the "mags" as a result of the moving magnetic pulse shown in the first line of the figure. When the concentration peak occurs at $x_o$, the "mags" are flushed out;

FIG. 7 is a graph showing the effect of particle size on the ratio of magnetic force to opposing forces on a pyrite particle ($x=25\times10^{-6}$ cgs units; field=20 kOe; wire diameter=100 $\mu$m; $R_p$=particle radius=150 $\mu$m; $\Theta_p=0$ radians);

Principle of HGMS

In order to understand the method of operation of HGMS, we first examine the forces on a weakly paramagnetic particle moving in a slurry. Let us consider a small particle of spherical shape of radius "a".

The magnetic tractive force on the particle immersed in a magnetic field of spatial gradient $\nabla|H|$ is $$Fm=\underline{M}(\underline{H})\cdot\nabla|\underline{H}|v, \quad (1)$$

where $\underline{M}$, the magnetic moment per unit volume $=\chi\underline{H}$; $\chi$ being the volume susceptibility of the particle, $v$ is the volume of the particle i.e., $(4/3)\pi a^3$, and $\underline{H}$ the magnetic field intensity.

The magnetic force can be maximized by increasing the field and/or the gradient. Increasing the field of course causes M to go up in value and this without saturation for most paramagnetic substances even for very high fields. If the gradient $\nabla|\underline{H}|$ on the other hand is due to the fringing field from many small elements of ferromagnetic material, the highest value of $\nabla|\underline{H}|$ for a given material size corresponds to the field that saturates it. Hence it is advantageous to use small sizes of ferromagnetic material in fields of the order of 7kOe or less. It is readily shown by means of dimensional arguments that $F_m$ is highest for the characteristic size of the ferromagnetic material elements to be about the same as the size of the particle so that $F_m$ is proportional to $a^2$.

Conventional separators [5] (FIG. 1) consist of a packed column of stainless steel wool inserted vertically in the bore of a solenoidal magnet. The coal ground in fine particles is transported as a slurry through the column of the separator. The pyrite particles carried in the water slurry that flows by gravity through the column are subjected to the magnetic force $F_m$ mentioned above as well as to a buoyancy force, $F_b$, and to a hydrodynamic drag (Stokes) force $F_d$. The balancing of these forces in the vertical direction yield $$F_m \text{ (vertical)} \rightleftarrows F_d + F_b \quad (2)$$

as the condition for the pyrite particle to be trapped by the steel wool in the separator. The drag forces vary like the first power of the radius a of the particles, while $F_b$ varies like $a^3$. It is found that the ratio of the magnetic force to the drag and the buoyancy forces is a function of the particle sizes being in fact greater than unity (i.e., trapping occurs) for sizes between 50 and 150 microns. (FIG. 7).

Figure 8:
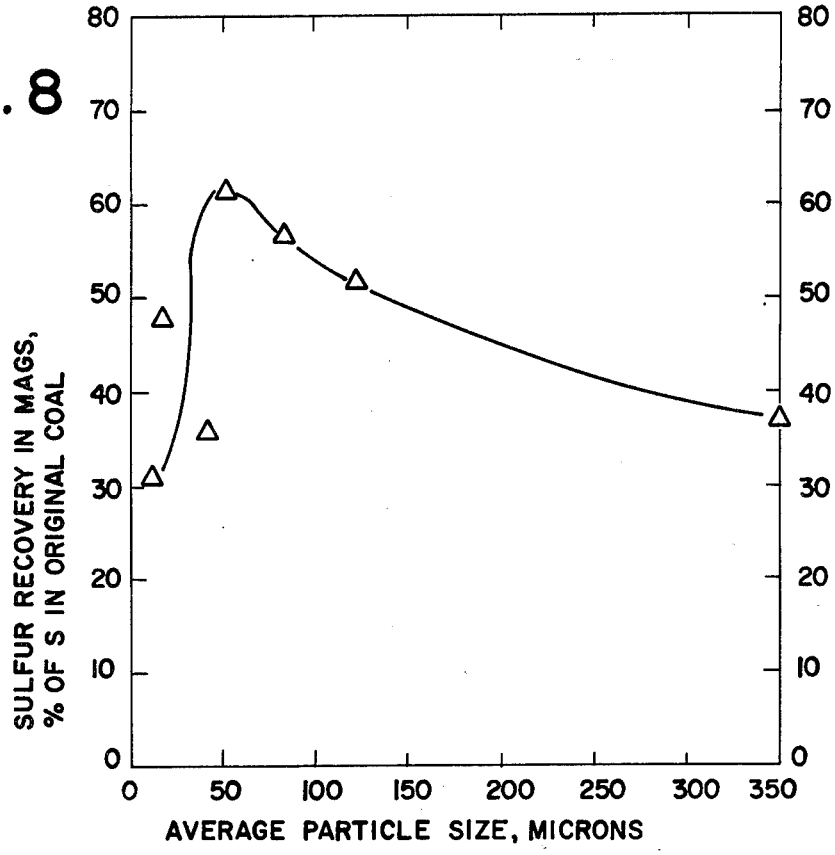
FIG. 8 is a graph showing the effect of particle size on sulfur recovery in mags (field=20 kOe; steel screens packing=91 percent void; slurry concentration=2.6 gm/100 ml; slurry velocity=2.3–2.6 cm/sec)

The amount of desulfurization that can be achieved depends not only on the particle sizes, but as evident from Eq. (1), on the strength of the field and on the velocity of the slurry (which affects the drag). Actual experiments on a specific coal shows the extent of trapping obtained for a field of 20 kOe, slurry concentration 2.6 gm/100 ml and for a slurry velocity of 2.3–2.6 cm/sec. It is noticed that up to 60% of the sulfur can be trapped for particle sizes of the order of about 50 microns. (FIG. 8).

There are two other important aspects of an HGMS separator which needs to be discussed. The first one deals with the mathematical modeling for commercial practice and the second with the engineering requirements for continuous operation of a separator.

Mathematical Modeling of Commercial HGMS

The calculations outlined in the previous section were obtained on the basis of the forces prevalent in the vicinity of a single magnetizable fiber. What is needed, however, is the development of the magnetic filtration performance of a commercial HGMS i.e., a filter composed of many fibers.

Figure 9:
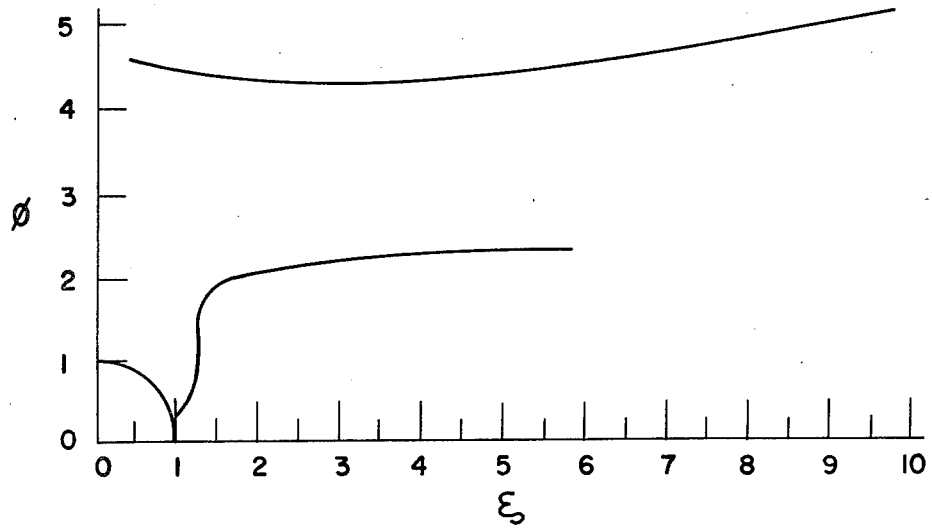
FIG. 9 is a graph showing typical particle trajectories in the x-y plane (perpendicular to the axis of the fiber) for values of the parameter $$\frac{V_m}{V_o}\phi = \frac{y}{b} \text{ and } \xi = \frac{x}{b}.$$

The starting point of the derivation is the evaluation of the trajectory of a small weakly paramagnetic spherical particle as it is transported past a ferromagnetic fibre. Watson (6) obtained the condition for such a article to be trapped and the results of his derivations are shown in FIG. 9. In this figure, $V_m$ is $$\frac{2}{9}\ \frac{\chi MHa^2}{\eta b},$$

wherein b is the diameter of the fiber, $\eta$ the viscosity of the fluid in which the particle is transported and $V_o$ is the velocity of the fluid. The calculations of Watson indicated that there is a critical value $$\frac{y}{b}\Big)_c = a_c,$$

such that if the initial coordinate for the particle, far from the fiber is less than $a_c$, the particle is trapped. Thus the capture cross section per unit length of the fiber is $2a_c$. It is clear that $a_c$ is a function of $V_m/V_o$. Watson finds that $a_c \approx \frac{1}{2}(V_m/V_o)$ for $V_m/V_o << 1$, while $a_c$ varies according the to the log c $V_m/V_o$ for values of $V_m/V_o > 10$.

The extensions of the trapping criteria to the filter performance have been performed by several investigators [7,8] including Watson. (Ref. 6). The derivation is based on a simple scattering model which ignores the details of the particle trajectories but places instead more emphasis on economic and technical requirements. If the filter transmittance is denoted by T, defined by $c_o/c$, where $c_o$ is the concentration of magnetic particles at the output of a magnetic filter of length L and c is the concentration of particles at the input of the filter, then $$T = \frac{c_o}{c} = \exp - \left(\frac{p_s p_c L}{c}\right) \quad (3)$$

where $p_c$ is the probability of collision with the collection surface (expressed per particle per length of travel) and $p_s$ the conditional probability of sticking once having collided.

If one assumes a Stokes law for the drag, then it can be shown that $$T = \exp(-4\pi\chi M((a/b))^2 H \tau \chi(1-\chi)/9\rho)$$

In the above expression X = the fractional amount of magnetic surface available (i.e. fractional void volume = 1 − X and $\tau$ = filter length/flow velocity = $L/V_o$).

The above expression for the transmittance has been verified by extensive measurements performed by workers in the clay industry.

DESCRIPTION OF THE PREFERRED EMBODIMENTS

This invention relates to a high gradient magnetic separator and method therefor, which operates in a continuous mode without recourse to mechanical moving parts.

In the invention, coal or other raw material is placed in a fluid stream of, gas or slurry, and moved into an elongated container or pipe PP which forms the core of the separator. This container or pipe is filled with a matrix of magnetizable material which is one form is stainless steel wool for a slurry and stainless steel needles for a gas. The relative alignment of the fibers and directions of flow of the magnetic field are similar to that of conventional separators as in U.S. Pat. No. 3,887,457, 3,627,678 or 3,567,026 and are shown diagrammatically in FIG. 1.

In the invention, coils $C_1, C_2 \ldots C_n$ are energized, the concentration of pyrite in PP is according to exponential law shown in Eq (4) and schematically in FIG. 4.

Figure 5A:
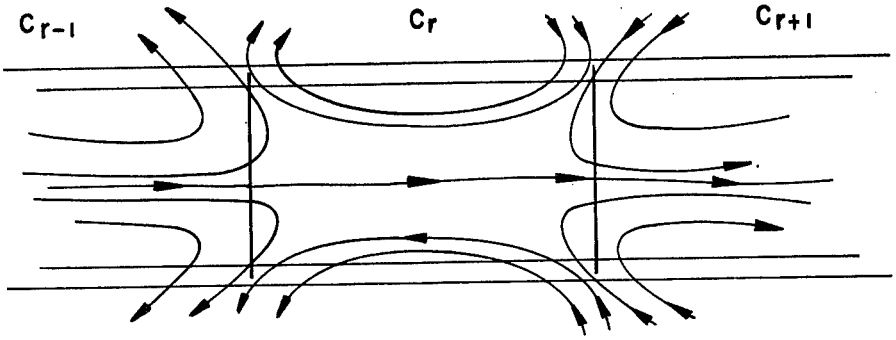
FIG. 5(*a*) is a view of the magnetic lines of force of three consecutive coils Cr-1, Cr and Cr+1 in which the field due to Cr opposes its adjacent coils causing the magnetic intensity to be as shown in FIG. 5(*b*)
Figure 5B:
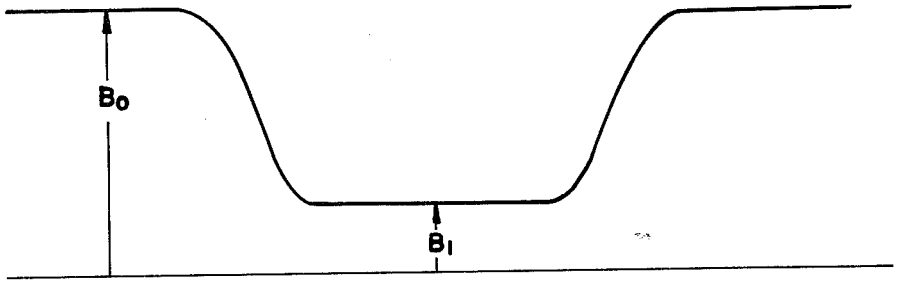

When the field in one of the coils, say $C_r$ is reversed, the intensity of the field in the region aa inside PP is reduced. The configuration of the lines of force are represented in FIG. 5(*a*) which describes the partial cancellation of the field so as to produce a distribution similar to that in FIG. 5(*b*).

When the field in aa falls below the critical value taught by Watson (See FIG. 9 and Ref. 6), the pyrite is no longer trapped by the steel wool in aa and is swept away from aa by the incoming flow of slurry arriving with a velocity $V_o$. If the various coils $C_1, C_2 \ldots$ are reversed in sequence, a traveling magnetic wave propagates down the pipe PP and the corresponding concentration of the trapped pyrite changes from that in FIG. 4 in sequence through the distributions shown in FIG. 6 where the temporal evolution of the distribution for concentration is displayed.

If the speed of propagation of the magnetic wave is $V_m$, then after a time $\tau_m = 1/V_m$ the concentration of pyrite is a maximum at the end of the separator region $\delta$. Since at that time the magnetic field of coil $C_n$ is lowest, the pyrite is washed out by the incoming flow and is transported in the region $\delta$ which is field free. At that instance, a pulse of water is injected at diverter valve T so that the pyrite (as well as some coal) is flushed out and leaves by the pipe T'. The additional coil $C_n+1$ is placed there to trap any residual pyrite that has seeped through PP past the diverter.

The enriched (in pyrite) slurry which leaves at T' is refiltered by another smaller separator or simply discarded. The amount of coal that is periodically ejected at T' can be calculated as follows: Every $\tau_m$ seconds, the volume of coal lost is A $\delta$ (where A is the cross-sectional area of PP). During that interval the flow discharge is $AV_o\tau_m$. The fractional loss is $\delta/V_o\tau_m$.

If this coal is filtered through an identical filter then the loss becomes $(\delta/V_o\tau_m)^2$ which is of the order of 1% or less. A two-stage filter would be more adequate to reduce the coal losses to an insignificant amount.

In the first model of the invention the separator in FIG. 3 produced a field of about 8—9kOe. The diameter of PP was approximately one inch. The length l of PP was about 2 m and coils were used. The coal slurry flowed with a velocity of about 3cm/sec and a magnetic wave velocity of 1.5 cm/sec traversed PP (i.e. 2 m) in about 130 secs., which resulted in a 1/4% loss in coal for a 1 cm diameter for $\delta$.

The invention has been described with reference to the preferred embodiment. Obviously, modifications and alterations will occur to others upon the reading and understanding of this specification. It is our intention to include all such modifications and alterations insofar as they come within the scope of the appended claims or the equivalents thereof.

References

Figure 1:
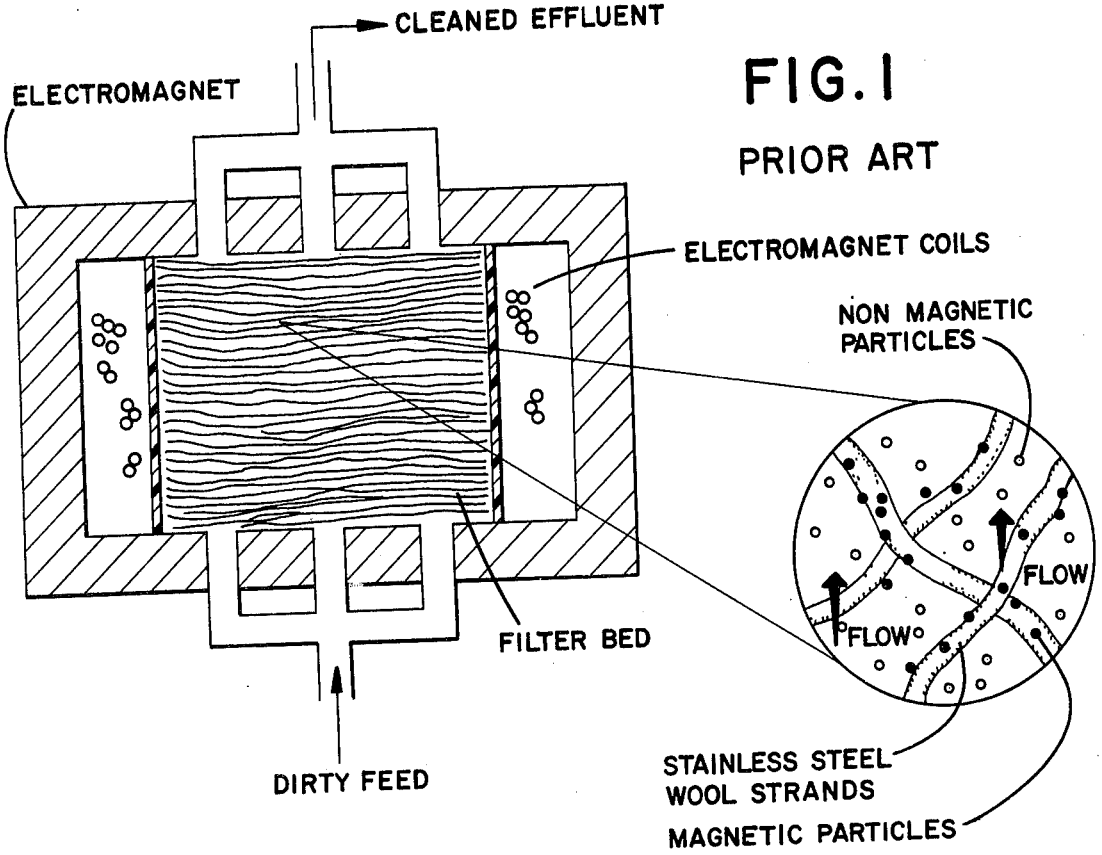
FIG. 1 PRIOR ART
FIG. 1 is a schematic diagram of the prior art.
Figure 2:
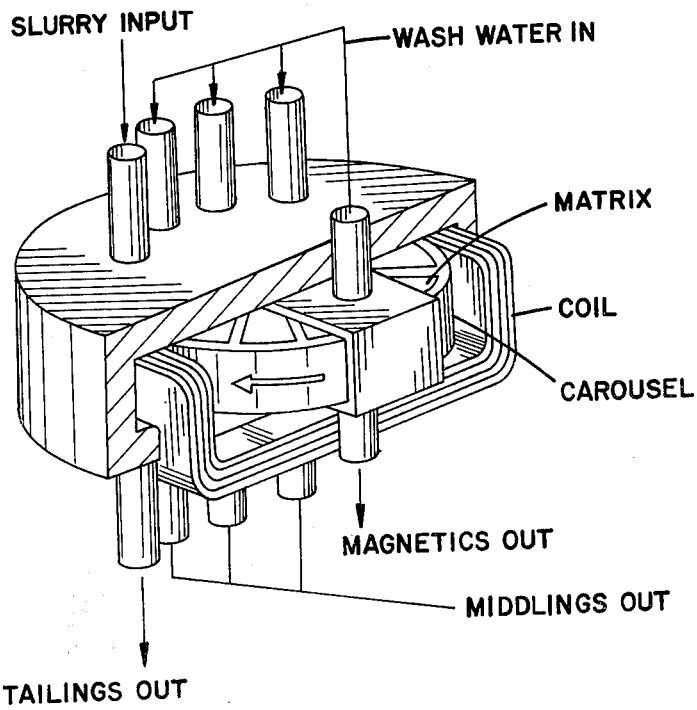
FIG. 2 PRIOR ART
FIG. 2 is a view partially broken away of a carousel high gradient magnetic separator of the prior art.

1. H. Kolm et al., "High Intensity Magnetic Filtration" Magnetism & Magnetic Materials Conference, Proceedings 1971.
2. R. R. Oder & C. R. Price TAPPI 56, 75–78 (1973).
3. S. C. Trindade & H. Kolm IEEE Trans. on Mag. MAG 9, 310 (1973).
4. S. Ergun & E. H. Bean "Magnetic Separation of Pyrite from Coals". Report of Investigation No. 7181 U.S. Bureau of Mines, Pittsburgh (Sept. 1968).
5. The schematic drawing of FIG. 1 shows a construction similar to that manufactured by SALA.
6. J. H. P. Watson, J. Appl. Phys. 44, 4209 (1973).
7. C. P. Bean, Bull, Am. Phys. Soc. 16, 350, (1971).

8. R. R. Oder & C. R. Price. Clays and Clay Minerals 24 (1976).
9. Annual Report 1971–1972, Francis Bitter National Laboratory, Massachusetts Institute of Technology p. 148 ff.
10. HGMS with continuous moving matrix U.S. Pat. No. 3,902,994.

What is claimed is:

1. A high gradient magnetic separator for removing magnetic particles from a stream of material comprising:

an elongated container having an inlet, an outlet and diverter means;

a matrix of magnetizable material within said container;

a plurality of magnetic coils surrounding said container and in sequence along the container between said inlet and outlet, each magnetic coil being magnetizable to produce a magnetic field applied parallel to the motion of the stream of material; means for magnetizing said coils to trap magnetic particles in the matrix;

means for demagnetizing said coils in sequence along the direction of the stream to sequentially release magnetic particles therein thereby forming a traveling magnetic wave in said stream of material to collect and remove the trapped particles to said diverter means; and flushing means separating a stream containing a concentrate of said trapped particles thru said diverter means.

2. The separator of claim 1, in which the matrix is stainless steel wool.

3. The separator of claim 1, in which the meaning for demagnetizing includes a means for producing a reversing field.

4. The separator of claim 1, in which the diverter means is positioned before the last coil.

5. A method of high gradient magnetic separation for the removal of magnetic particles from a stream of material having solid magnetic particles and a carrier therefor moving along a normal path, which comprises:

passing a stream of the material along a separator having a magnetizable matrix;

magnetizing discrete sections of the matrix separately to produce a magnetic field in the matrix sections parallel to the stream and to trap magnetic particles in the matrix sections;

demagnetizing said matrix sections sequentially in the direction of flow of the stream to form a traveling magnetic wave to progressively sweep away said magnetic particles from the matrix sections with the flow of the carrier; and diverting a portion of the stream containing a concentrate of said magnetic particles from its normal path and sequentially flushing said diverted stream when said swept particles leave the last matrix section.

6. The method of claim 5, in which the carrier means is a slurry.

7. The method of claim 5, in which the carrier means is a gas.

8. The method of claim 5, including passing the undiverted portion of said stream through a magnetized additional matrix downstream of the diverter.

* * * * *